US007750568B2

(12) United States Patent
Kang et al.

(10) Patent No.: US 7,750,568 B2
(45) Date of Patent: Jul. 6, 2010

(54) PLASMA DISPLAY PANEL (PDP) HAVING A REFLECTION PREVENTIVE LAYER

(75) Inventors: Chong-Gi Kang, Suwon-si (KR); Tae-Kyoung Kang, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 1184 days.

(21) Appl. No.: 11/246,378

(22) Filed: Oct. 11, 2005

(65) Prior Publication Data

US 2006/0076890 A1 Apr. 13, 2006

(30) Foreign Application Priority Data

Oct. 12, 2004 (KR) ..... 10-2004-0081346

(51) Int. Cl.
*H01J 17/49* (2006.01)

(52) U.S. Cl. ..... 313/586; 313/582

(58) Field of Classification Search ..... 313/582–587; 315/169.1, 169.4; 345/37, 41, 60, 71; 252/301
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0063510 | A1 * | 5/2002 | Yura et al. | 313/483 |
| 2004/0000870 | A1 * | 1/2004 | Kifune et al. | 313/582 |
| 2004/0051457 | A1 * | 3/2004 | Kimura et al. | 313/586 |
| 2006/0006802 | A1 * | 1/2006 | Kang | 313/582 |

FOREIGN PATENT DOCUMENTS

| | | |
|---|---|---|
| JP | 2845183 | 10/1998 |
| JP | 2917279 | 4/1999 |
| JP | 2000-067764 | 3/2000 |
| JP | 2001-043804 | 2/2001 |
| JP | 2001-325888 | 11/2001 |
| KR | 10-2002-0091754 | 12/2002 |

OTHER PUBLICATIONS

T. Kunimoto et al., "Feasibility Study of Silicate Phosphor CaMgSi2O6:Eu2+ as Blue PDP Phosphors", IEICE Trans. Electron. VOI E85 X No. 11, 1888-1889.*

(Continued)

*Primary Examiner*—Joseph L Williams
(74) *Attorney, Agent, or Firm*—Robert E. Bushnell, Esq.

(57) ABSTRACT

A Plasma Display Panel (PDP) includes: a first substrate; a second substrate arranged parallel to the first substrate; a partition wall interposed between the first and second substrates; a groove formed on the partition wall; and a reflection preventive layer formed on the groove to reduce reflective luminance in a display area.

28 Claims, 5 Drawing Sheets

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. In 2003, and Appendix A—Description of Technology, Annex B—Relationship Between Voltage Terms and Discharge Characteristics; Annex C—Gaps and Annex D—Manufacturing.

Japanese Office action dated on Jul. 1, 2008 for corresponding Japanese Patent Application No. 2005-205916.

* cited by examiner

PLASMA DISPLAY PANEL (PDP) HAVING A REFLECTION PREVENTIVE LAYER

CLAIM OF PRIORITY

This application makes reference to, incorporates the same herein, and claims all benefits accruing under 35 U.S.C. §119 from an application entitled PLASMA DISPLAY PANEL, earlier filed in the Korean Intellectual Property Office on Oct. 12, 2004 and there duly assigned Serial No. 10-2004-0081346.

BACKGROUND OF THE INVENTION

1. Field of the Invention

The present invention relates to a Plasma Display Panel (PDP), and more particularly, to a PDP that has a groove formed on a partition wall and covered with a reflection preventive layer to reduce reflective luminance.

2. Description of the Related Art

In general, PDPs are flat panel display devices in which a discharge gas is contained between two substrates and including a plurality of discharge electrodes that generate a discharge, and phosphor layers that are excited by ultraviolet rays generated by the discharge to display desired numbers, characters, and images.

A PDP includes a front substrate, a rear substrate, pairs of sustain electrodes, i.e., X and Y electrodes, disposed on an inner surface of the front substrate, a front dielectric layer covering the sustain electrode pairs, a protecting layer deposited on a surface of the front dielectric layer, an address electrode formed on an inner surface of the rear substrate in a direction crossing the direction in which the sustain electrode pairs are disposed, a rear dielectric layer covering the address electrode, a plurality of partition walls interposed between the front and rear substrates, and red, blue and green phosphor layers coated in discharge cell defined by the partition walls.

The PDP structured as described above has an electrical signal supplied to a Y electrode and an address electrode to select a discharge cell. The PDP also has an electrical signal alternately supplied to the sustain discharge electrodes. Then, a surface discharge occurs on the inner surface of the front substrate, thereby generating ultraviolet rays which impinge upon the phosphor layer. Visible light is emitted from the phosphor layer in the selected discharge cell, and a still image or a moving image is displayed as a result.

The red, green, and blue phosphor layers coated inside the discharge cells of the PDP are white themselves. Hence, the reflective luminance of the phosphor layers coated inside the discharge cells which have not been selected is considerably high. The high reflective luminance undermines bright contrast in a room and thus deteriorates image quality.

SUMMARY OF THE INVENTION

The present invention provides a Plasma Display Panel (PDP) that has a groove formed on a partition wall and that has the groove covered with a reflection preventive layer to reduce reflective luminance.

According to an aspect of the present invention, a Plasma Display Panel (PDP) is provided comprising: a first substrate; a second substrate arranged parallel to the first substrate; a partition wall formed on the first substrate along a direction and interposed between the first and the second substrate; a groove formed on the partition wall and extended along the direction; and a reflection preventive layer formed on the groove.

According to an aspect of the present invention, a Plasma Display Panel (PDP) is provided further comprising: a first substrate; a second substrate arranged parallel to the first substrate; a partition wall formed on the first substrate along a direction and interposed between the first and the second substrate; a groove formed on the partition wall and extended along the direction; and a reflection preventive layer formed on the groove wherein the reflection preventive layer is made of CMS fluorescent material.

According to another aspect of the present invention, a Plasma Display Panel (PDP) is provided comprising: a first substrate; a second substrate arranged parallel to the first substrate; a plurality of address electrodes formed on the first substrate along a first direction; a plurality of common and scan electrodes formed on the second substrate along a second direction perpendicular to the first direction; a dielectric layer formed on both the first and the second substrate and covering the address, the common and the scan electrodes; a partition wall formed on the dielectric layer of the first substrate along the second direction and interposed between the first and the second substrate; a groove formed on the partition wall and extended along the second direction; and a reflection preventive layer formed on the groove.

According to another aspect of the present invention, a Plasma Display Panel (PDP) is provided further comprising: a first substrate; a second substrate arranged parallel to the first substrate; a plurality of address electrodes formed on the first substrate along a first direction; a plurality of common and scan electrodes formed on the second substrate along a second direction perpendicular to the first direction; a dielectric layer formed on both the first and the second substrate and covering the address, the common and the scan electrodes; a partition wall formed on the dielectric layer of the first substrate along the second direction and interposed between the first and the second substrate; a groove formed on the partition wall and extended along the second direction; and a reflection preventive layer formed on the groove wherein the reflection preventive layer is made of CMS fluorescent material.

The PDP preferably further comprises the reflection preventive layer fills inside the groove and covers a top portion of the partition wall.

The PDP further comprises that a gas exhaust path formed between a gap provided by the groove and the second substrate.

A width of the groove is preferably narrower than a width of the partition wall.

A depth of the groove is preferably greater than 0 μm and less than a height of the partition wall.

The reflection preventive layer preferably comprises $CaMgSi_2O_8:Eu^{2+}$. The reflection preventive layer alternatively preferably comprises a mixture of $CaMgSi_2O_8:Eu^{2+}$ and $BaMgAl_{10}O_{17}:Eu^{2+}$.

The reflection preventive layer made of CMS fluorescent material preferably further comprises $CaMgSi_2O_8:Eu^{2+}$. The reflection preventive layer made of CMS fluorescent material alternatively preferably further comprises a mixture of $CaMgSi_2O_8:Eu^{2+}$ and $BaMgAl_{10}O_{17}:Eu^{2+}$.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
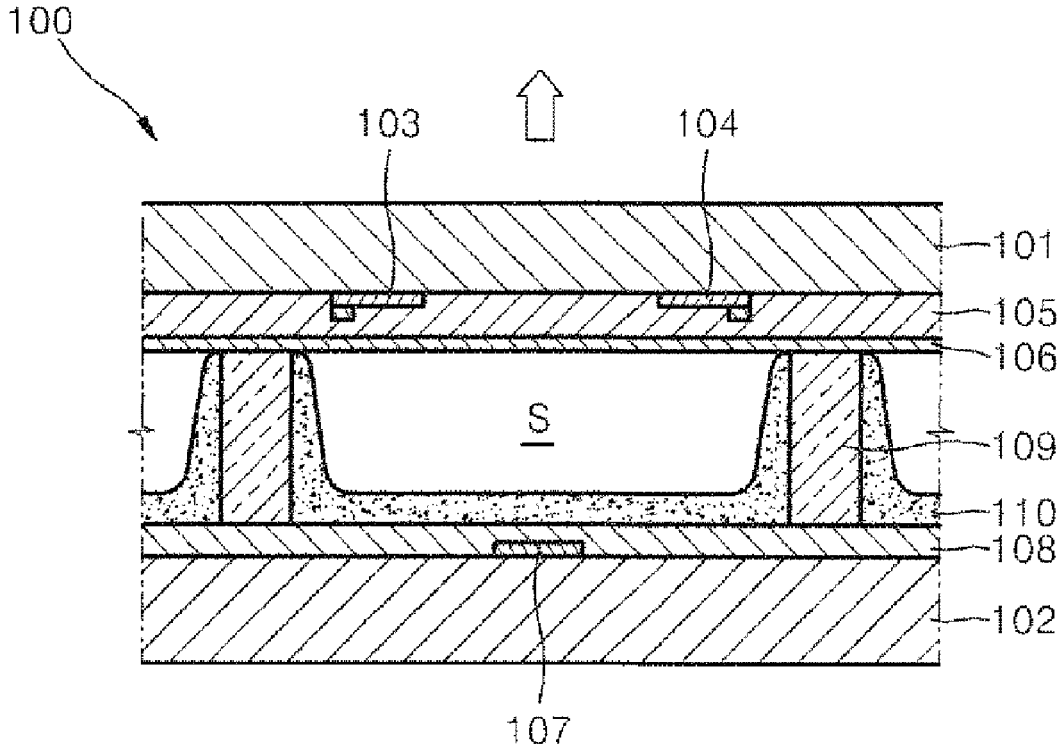
FIG. 1 (PRIOR ART)
FIG. 1 is a cross-sectional view of a Plasma Display Panel (PDP)

Referring to FIG. 1, a Plasma Display Panel (PDP) 100 includes a front substrate 101, a rear substrate 102, X and Y electrodes 103 and 104 disposed on an inner surface of the front substrate 101, a front dielectric layer 105 covering the X and Y electrodes 103 and 104, a protecting layer 106 deposited on a surface of the front dielectric layer 105, an address electrode 107 formed on an inner surface of the rear substrate 102 in a direction crossing the direction in which the X and Y electrodes 103 and 104 are disposed, a rear dielectric layer 108 covering the address electrode 107, a plurality of partition walls 109 interposed between the front and rear substrates 101 and 102 to partition discharge spaces, and red, blue and green phosphor layers 110 coated inside the partition walls 109.

Figure 2:
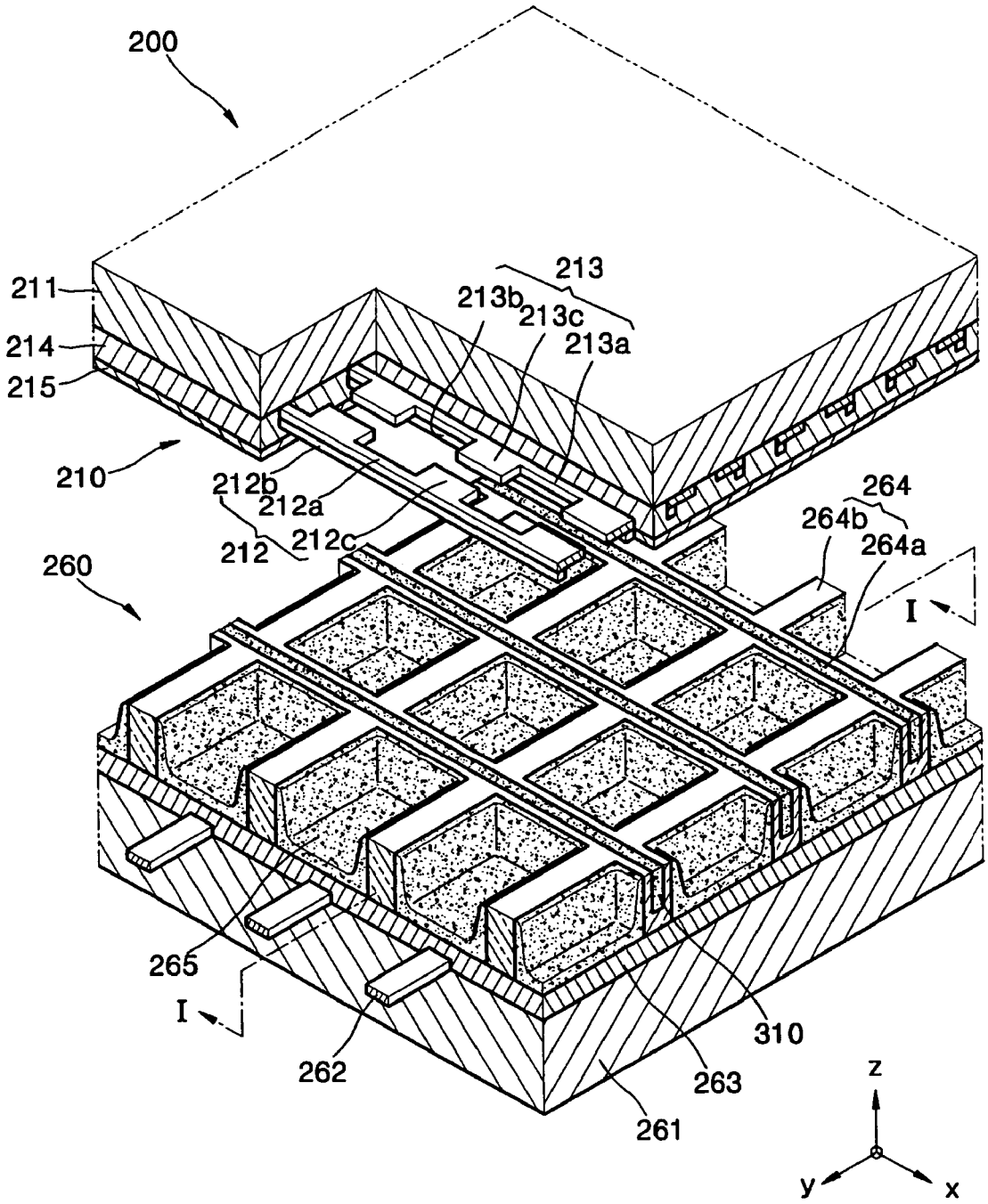
FIG. 2 is an exploded perspective view of a portion of a PDP according to a first embodiment of the present invention.
Figure 3:
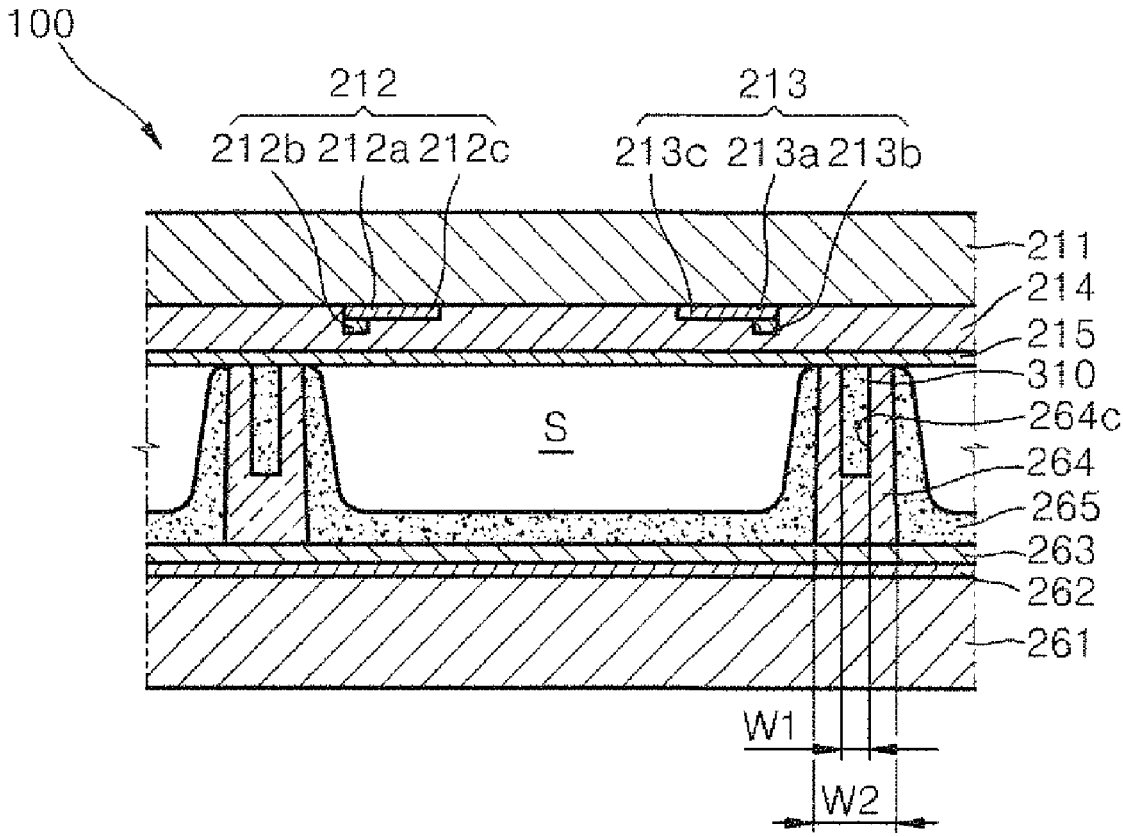
FIG. 3 is a cross-sectional view of the PDP taken along line I-I of FIG. 3.

FIG. 2 is an exploded perspective view of a portion of a PDP 200 according to a first embodiment of the present invention. FIG. 3 is a cross-sectional view of the PDP 200 taken along line I-I of FIG. 3.

Referring to FIGS. 2 and 3, the PDP 200 includes a front panel 210 and a rear panel is 260 disposed opposite to the front panel 210. The front and rear panels 210 and 260 are attached to each other by frit glass arranged along the edges of surfaces of the front and rear panels 210 and 260, which face each other. Thus, the PDP 200 is sealed from the outside.

The front panel 210 includes a transparent front substrate 211, for example, soda lime glass. X and Y electrodes 212 and 213 are formed on a lower surface of the front substrate 211 in an X direction of the PDP 200. A pair of X and Y electrodes 212 and 213 are included in each discharge cell.

The X electrode 212 includes a first transparent electrode line 212*a* formed on an inner surface of the front substrate 211 and a first bus electrode line 212*b* overlapping the first transparent electrode line 212*a*. A plurality of first protrusions 212*c* of a predetermined size protrude from an inner wall of the first transparent electrode line 212*a* toward the Y electrode 213.

The Y electrode 213 is actually symmetrical to the X electrode 212, and includes a second transparent electrode line 213*a* formed on the inner surface of the front substrate 211 and a second bus electrode line 213*b* overlapping the second transparent electrode line 213*a*. A plurality of second protrusions 213*c* of a predetermined size protrude from an inner wall of the second transparent electrode line 213*a* toward the X electrode 212.

The first and second transparent electrode lines 212*a* and 213*a* are formed of transparent conductive films, for example, Indium Tin Oxide (ITO) films, to enhance an aperture ratio of the front substrate 211. The first and second bus electrode lines 212*b* and 213*b* are formed of highly conductive metallic materials, for example, Ag paste or a chrome-copper-chrome alloy, to reduce the line resistance of the first and second transparent electrode lines 212*a* and 213*a* and to improve their electrical conductivity.

A space between a pair of X and Y electrodes 212 and 213 and another adjacent pair of X and Y electrodes 212 and 213 is a non-discharge area. The non-discharge area may further include a black striped layer to enhance contrast.

The X and Y electrodes 212 and 213 are covered by a front dielectric layer 214. The front dielectric layer 214 is formed of glass paste with various fillers added. The front dielectric layer 214 can be selectively printed on a portion of the front substrate 211 where the X and Y electrodes 221 and 222 are patterned. Alternatively, the front dielectric layer 214 can be printed on the entire lower surface of the front substrate 211. A protective layer 215, such as an MgO layer, is deposited on a surface of the front dielectric layer 214 to protect the front dielectric layer 214 from being damaged and to increase emission of secondary electrons.

The rear panel 260 includes a rear substrate 261. A plurality of address electrodes 262 are disposed on the rear substrate 261 in a direction crossing a direction in which the X and Y electrodes 212 and 213 are disposed. The address electrodes 262 are covered by a rear dielectric layer 263.

A plurality of partition walls 264 partitioning discharge spaces are formed between the front and rear panels 210 and 260. The partition walls 264 include a plurality of first partition walls 264*a* disposed in a direction crossing the direction in which the address electrodes 262 are disposed and a plurality of second partition walls 264*b* disposed in parallel to the address electrodes 262.

A discharge gas such as Ne—Xe or He—Xe is injected into discharge cells partitioned by the front panel 210, the rear panel 260, and the partition walls 264. In addition, red, green, and blue phosphor layers 265, which are excited by ultraviolet rays generated by the discharge gas, are coated in the discharge cells. The red, green, and blue phosphor layers 265 can be coated anywhere in the discharge cells. In the present embodiment, the phosphor layers 265 are coated on inner walls of the partition walls 264 and on the rear dielectric layer 263.

A plurality of reflection preventive layers 310 are formed between the front and rear panels 210 and 260 to reduce reflective luminance in a display area where an image is displayed. The reflection preventive layers 310 can be disposed anywhere in the non-discharge area. Preferably, the reflection preventive layers 310 can be formed on the partition walls 264 partitioning the discharge cells.

More specifically, the partition walls 264 partitioning the discharge spaces are disposed between the front and rear panels 210 and 260. The partition walls 264 include the first partition walls 264*a* disposed in an X direction of the PDP 200 and the second partition walls 264*b* disposed in a Y direction of the PDP 200. Each of the first partition walls 264*a* is integrated into the second partition walls 264*b* and extends in a direction crossing a direction in which adjacent pairs of the second partition walls 264*b* are disposed, and the integrated first and second partition walls 264*a* and 264*b* formed in a matrix structure to partition the discharge spaces.

The partition walls 264 can be formed in a meander, delta, or honeycomb structure according to various embodiments of the present invention, and the discharge cells partitioned by the partition walls 264 can be square, polygonal, or circular.

The red, green, or blue phosphor layer 265 is coated in each discharge cell. The red phosphor layer 265 can be formed of $(Y,Gd)BO_3:Eu^{+3}$, the green phosphor layer 265 can be formed of $Zn_2SiO_4:Mn^{2+}$, and the blue phosphor layer 265 can be formed of $BaMgAl_{10}O_{17}:Eu^{2+}$.

A plurality of grooves 264*c* are formed on the first partition walls 264*a* and covered by the reflection preventive layers 310.

The grooves 264*c* are vertically arranged from upper end portions of the partition walls 264*a* to a predetermined depth in a negative Z direction. The grooves 264*c* are formed as stripe-shaped through-holes along a lengthwise direction of the first partition walls 264*a* from one end to the other end of the first partition walls 264*a* in the non-discharge area. In addition, the grooves 264*c* are arranged approximately half the depth of the first partition walls 264*a* rather than penetrating down the first partition walls 264*a* from the center of the width of the first partition walls 264*a*.

Alternatively, the grooves 264*c* can be formed in the second partition walls 264*b* instead of the first partition walls 264*a* or formed in both the first partition walls 264*a* and the second partition walls 264*b*. The grooves 264*c* can not only be stripe-shaped, like a continuous band, but also be strip-shaped like a discontinuous band. Also, the grooves 264*c* can not only be square but can also be streamlined. In other words, the grooves 264*c* can take any shape as long as they are formed on the partition walls 264.

The reflection preventive layers 310 cover areas from the upper end portions of the first partition walls 264*a* to bottom surfaces of the groove 264*c*. In addition, a width W1 of each of the reflection preventive layers 310 is narrower than a width W2 of each of the first partition wall 264*a*.

The reflection preventive layers 310 can be made of CMS fluorescent material to reduce reflection luminance. The CMS fluorescent material can be $CaMgSi_2O_8:Ed^{2+}$. $CaMgSi_2O_8:Eu^{2+}$ is an organic combination of Ca, $MgO_6$, and $SiO_4$ and is used for the blue phosphor layer 265.

If $CaMgSi_2O_8:Eu^{2+}$ is fabricated in a paste form and applied to the partition walls 264 using a dispenser, it becomes grayish. While the PDP 200 is being driven, the grayish $CaMgSi_2O_8:Eu^{2+}$ can reduce reflected luminance and thus improve contrast.

Alternatively, the CMS fluorescent material for the reflection preventive layers 310 can be a mixture of $CaMgSi_2O_8:Eu^{2+}$ and $BaMgAl_{10}O_{17}:Eu^{2+}$, which is used as the blue phosphor layer 265 in the present embodiment.

Figure 4:
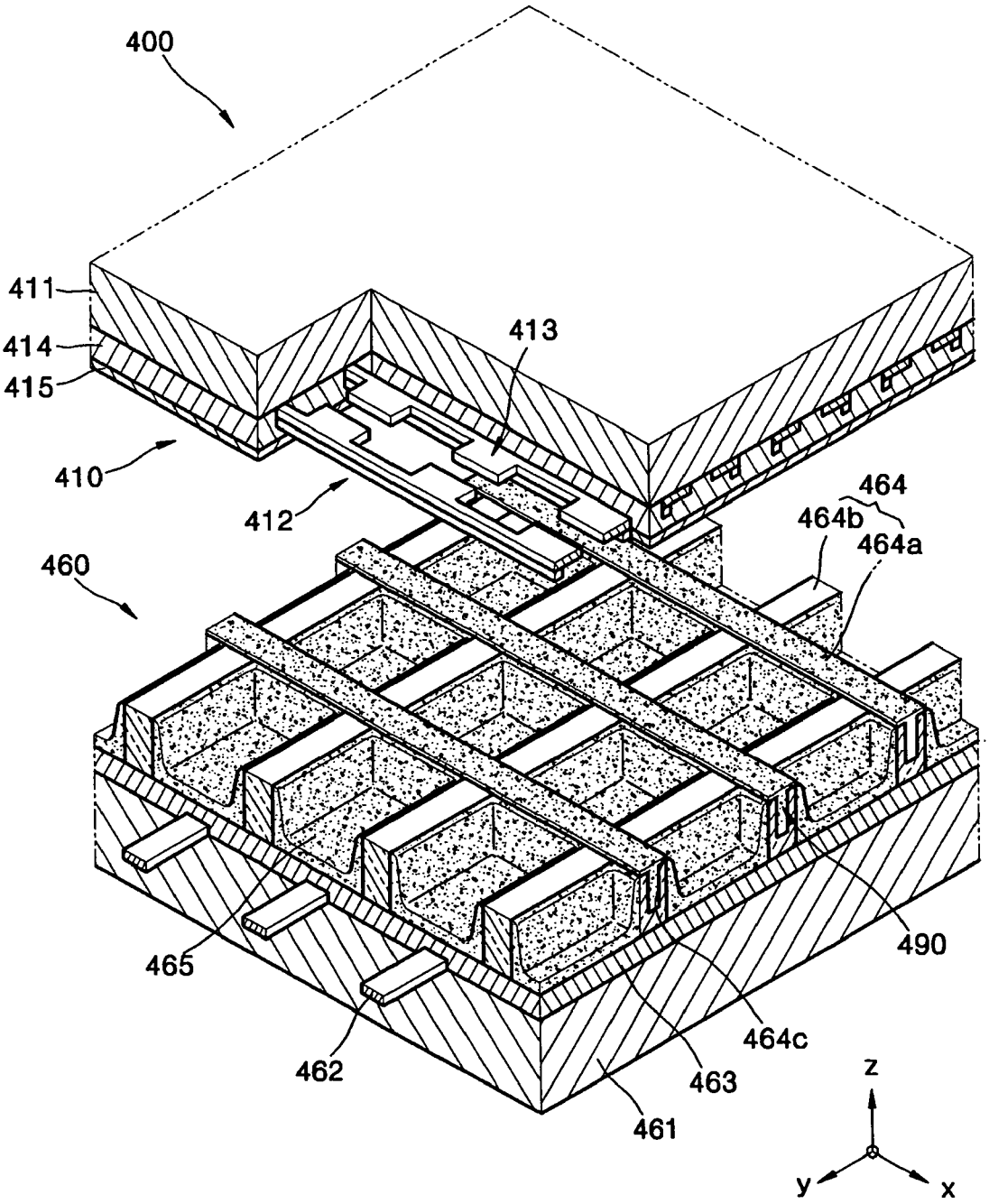
FIG. 4 is an exploded perspective view of a PDP according to a second embodiment of the present invention.

FIG. 4 is an exploded perspective view of a PDP 400 according to a second embodiment of the present invention. Referring to FIG. 4, the PDP 400 includes a front panel 410 and a rear panel 460. The front panel 410 includes a front substrate 411, X and Y electrodes 412 and 413 alternately disposed on the front substrate 411, a front dielectric layer 414 covering the X and Y electrodes 412 and 413, and a protective layer 415 deposited on a surface of the front dielectric layer 414. The rear panel 460 includes a rear substrate 461, a plurality of address electrodes 462 disposed on the rear substrate 461, and a rear dielectric layer 463 covering the address electrodes 462.

A plurality of partition walls 464 are formed between the front and rear panels 410 and 460 in a matrix structure. In addition, red, green, and blue phosphor layers 465 are arranged on inner walls of the partition walls 464 and on the rear dielectric layer 463. The partition walls 464 include a plurality of first partition walls 464*a* disposed in an X direction of the PDP 400 and a plurality of second partition walls 464*b* disposed in a Y direction of the PDP 400.

A plurality of grooves 464*c* are formed on the first partition walls 464*a* along a lengthwise direction of the first partition walls 464*a* and covered by a plurality of reflection preventive layers 490.

The reflection preventive layers 490 cover not only the entire top surfaces of the first partition walls 464*a* but also the grooves 464*c* arranged from the center of the width of the partition walls 464*a* to a predetermined depth. The predetermined depth is greater than 0 μm and less than a height of the partition wall. Therefore, cross-sections of the reflection preventive layers 490 are T-shaped. As described above, the reflection preventive layers 490 can be formed of CMS fluorescent material, for example, $CaMgSi_2O_8:Eu^{2+}$ or a mixture of $CaMgSi_2O_8:Eu^{2+}$ and $BaMgAl_{10}O_{17}:Eu^{2+}$.

Figure 5:
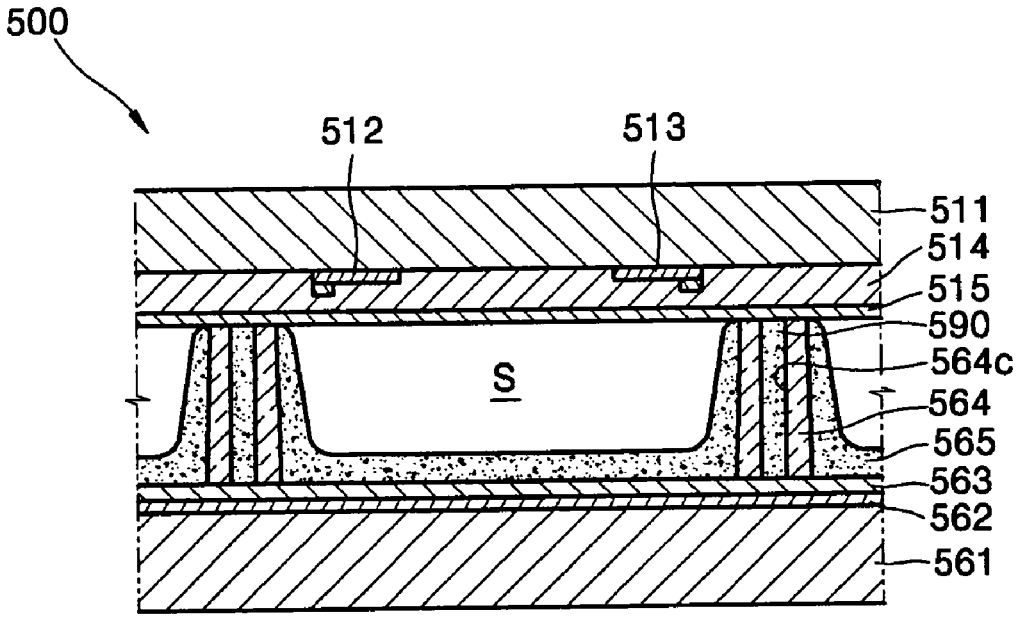
FIG. 5 is a cross-sectional view of a PDP according to a third embodiment of the present invention.

FIG. 5 is a cross-sectional view of a PDP 500 according to a third embodiment of the present invention. Referring to FIG. 5, X and Y electrodes 512 and 513, i.e., pairs of sustain electrodes, are alternately disposed on an inner surface of a front substrate 511 and covered by a front dielectric layer 514. A protective layer 515 is deposited on a surface of the front dielectric layer 514 to increase emission of secondary electrons. An address electrode 562 is formed on an inner surface of a rear substrate 561 and covered by a rear dielectric layer 563. A discharge cell is selected when an addressing voltage is supplied to the address electrode 562 and the Y electrode 513.

A partition wall 564 partitioning discharge spaces is interposed between the front and rear substrates 511 and 561, and a red, green, or blue phosphor layer 565 is coated inside the partition wall 564. A reflection preventive layer 590 is formed on the partition wall 564.

A groove 564*c* penetrates the partition wall 564 in a thickness direction of the partition wall 564 and along one direction of the PDP 500. The groove 564*c* penetrates down the partition wall 564 from the center of the width of the partition wall 564 thereby being the depth of the groove greater than 0 μm and less than a height of the partition wall. The groove is a stripe-shaped through-hole narrower than the width of the partition wall 564. The reflection preventive layer 590 is formed inside the groove of the partition wall 564 and completely covers the groove 564*c* penetrating the center of the partition wall 564. As described above, the reflection preventive layer 590 is formed of a colored material to reduce reflective luminance.

Figure 6:
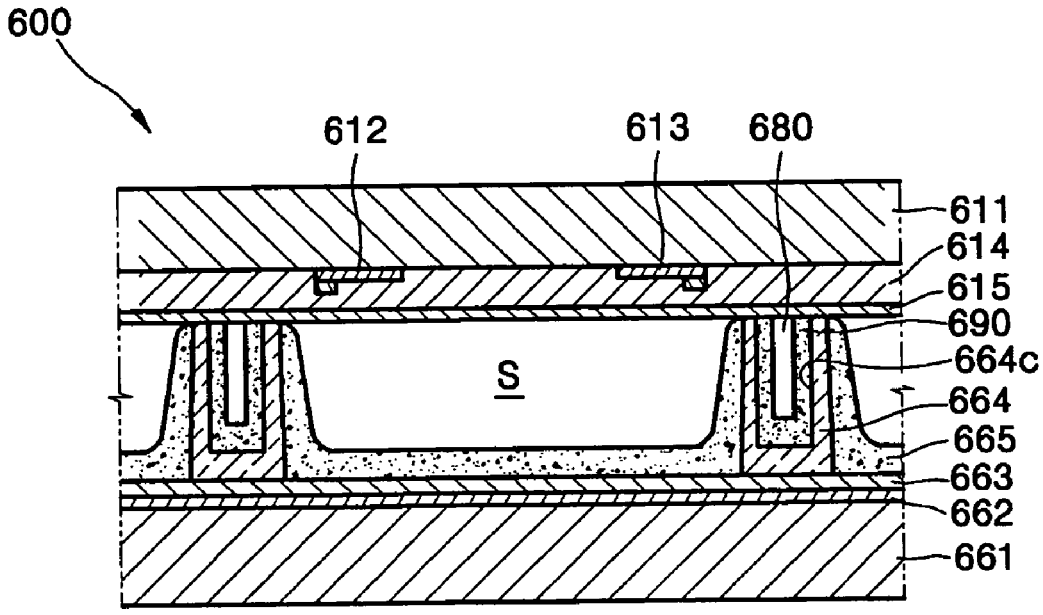
FIG. 6 is a cross-sectional view of a PDP according to a fourth embodiment of the present invention.

FIG. 6 is a cross-sectional view of a PDP 600 according to a fourth embodiment of the present invention. Referring to FIG. 6, front and rear substrates 611 and 661 are disposed opposite to each other. X and Y electrodes 612 and 613 to which a sustain discharge voltage is supplied are alternately disposed on an inner surface of the front substrate 611 and covered by a front dielectric layer 614. A protective layer 615 is deposited on a surface of the front dielectric layer 614. An address electrode 662, to which an addressing voltage is supplied, is disposed on an inner surface of the rear substrate 661 and covered by a rear dielectric layer 663. A partition wall 664 is interposed between the front and rear substrates 611 and 661, and a red, green, or blue phosphor layer 665 is arranged inside the partition wall 664.

In the present embodiment, a reflection preventive layer 690 is formed on the partition wall 664 to reduce reflective luminance. The partition wall 664 further includes a gas exhaust path 680 through which gas remaining inside the PDP 600 during vacuum exhaustion can be exhausted.

A groove 664*c* is formed on the partition wall 664 to a predetermined depth along one direction of the PDP 600. The groove 664*c* is a stripe-shaped through-hole extending from one end to the other end of the partition wall 664 and formed from an upper end portion of the partition wall 664 to the predetermined depth. The predetermined depth is greater than 0 μm and less than a height of the partition wall.

A reflection preventive layer 690 is arranged inside the groove 664*c*. The reflection preventive layer 690 does not completely cover the groove 664*c*. A portion of the covered groove 664*c* is left open to form the exhaust path 680 in a groove shape. The exhaust path 680 is formed along a lengthwise direction of the partition wall 664 and thus gas can be exhausted through the exhaust path 680. As described above, the reflection preventive layer 690 is formed of a colored material to reduce reflective luminance.

The operation of the PDP 200 structured as described above is described below with reference to FIGS. 2 and 3.

When a predetermined pulse voltage is supplied between the address electrodes 262 and the Y electrode 213 from an external power source, a discharge cell that will emit light is selected. Then, wall charges are accumulated inside the selected discharge cell.

When a positive voltage is supplied to the X electrode 212 and a voltage relatively higher than the positive voltage is supplied to the Y electrode 213, the wall charges move due to the difference between the voltages supplied to the X and Y electrodes 212 and 213.

As the wall charges move, they collide with discharge gas atoms in the selected discharge cell. In this process, a discharge occurs and plasma is generated as a result. The discharge starts from a gap between the X and Y electrodes 212 and 213 where the stronger electric field is formed and is diffused to peripheries of the X and Y electrodes 212 and 213.

After the discharge occurs, if a voltage difference between the X electrode 212 and the Y electrode 213 becomes lower than a discharge voltage, the discharge no longer occurs, and space charges and wall charges are formed in the selected discharge cell.

If the polarities of the voltages supplied to the X and Y electrodes 212 and 213 are inverted, the discharge occurs again with the help of the wall charges. In this way, if the polarities of the X and Y electrodes 212 and 213 are inverted, the initial discharge process is repeated. As the process repeats, the discharge occurs stably.

Ultraviolet rays generated by the discharge excite phosphor materials of the phosphor layers 265 arranged in the discharge cells. In this process, the visible light can be obtained. The visible light is emitted from each discharge cell to display a still image or a moving image.

The grooves 264*c* are formed on the partition walls 264, and are covered by the reflection preventive layers 310 formed of colored materials. Thus, reflected luminance in the display area of the PDP 200 where a still image or a moving image is displayed can be reduced.

As described above, a PDP according to the present invention can produce the following effects.

First of all, since a groove is formed on a partition wall and covered by a reflection preventive layer formed of a colored material, while the PDP is being driven, reflective luminance can be reduced.

Second, as the reflected luminance is reduced, the contrast of the PDP can be enhanced.

Third, a portion of the groove where the reflection preventive layer is formed can be left open to form an exhaust path. Thus, a gas can be exhausted through the exhaust path during vacuum exhaustion.

Fourth, sufficient exhaust ventilation through the exhaust path reduces impure gases remaining in the PDP and removes discharge stains at the center portion of the PDP.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:
- a first substrate;
- a second substrate arranged parallel to the first substrate;
- a partition wall formed on the first substrate along a direction, disposed between the first and the second substrate to define a plurality of discharge cells;
- a groove formed on the partition wall, extended along the direction and separated in respect to the plurality of discharge cells;
- a reflection preventive layer formed on the groove; and
- at least a portion of the reflection preventive layer filling an inside of the groove.

2. The PDP of claim 1, wherein the reflection preventive layer fills an inside of the groove and covers a top portion of the partition wall.

3. The PDP of claim 1, wherein a gas exhaust path is formed between a gap provided by the groove and the second substrate.

4. The PDP of claim 1, wherein a width of the groove is narrower than a width of the partition wall.

5. The PDP of claim 1, wherein a depth of the groove is greater than 0 μm and less than a height of the partition wall.

6. The PDP of claim 1, wherein the reflection preventive layer comprises $CaMgSi_2O_8:Eu^{2+}$.

7. The PDP of claim 1, wherein the reflection preventive layer comprises a mixture of $CaMgSi_2O_8:Eu^{2+}$ and $BaMgAl_{10}O_{17}:Eu^{2+}$.

8. A Plasma Display Panel (PDP), comprising:
- a first substrate;
- a second substrate arranged parallel to the first substrate;
- a partition wall formed on the first substrate along a direction, disposed between the first and the second substrate to define a plurality of discharge cells;
- a groove formed on the partition wall, extended along the direction and separated in respect to the plurality of discharge cells;
- a reflection preventive layer formed on the groove wherein the reflection preventive layer is made of CMS fluorescent material; and
- at least a portion of the reflection preventive layer filling an inside of the groove.

9. The PDP of claim 8, wherein the reflection preventive layer fills an inside of the groove and covers a top portion of the partition wall.

10. The PDP of claim 8, wherein a gas exhaust path is formed between a gap provided by the groove and the second substrate.

11. The PDP of claim 8, wherein a width of the groove is narrower than a width of the partition wall.

12. The PDP of claim 8, wherein a depth of the groove is greater than 0 μm and less than a height of the partition wall.

13. The PDP of claim 8, wherein the CMS fluorescent material comprises $CaMgSi_2O_8:Eu^{2+}$.

14. The PDP of claim 8, wherein the CMS fluorescent material comprises a mixture of $CaMgSi_2O_8:Eu^{2+}$ and $BaMgAl_{10}O_{17}:Eu^{2+}$.

15. A Plasma Display Panel (PDP), comprising:
- a first substrate;
- a second substrate arranged parallel to the first substrate;
- a plurality of address electrodes formed on the first substrate along a first direction;
- a plurality of common and scan electrodes formed on the second substrate along a second direction perpendicular to the first direction;

a dielectric layer formed on both the first and the second substrate and covering the address, the common and the scan electrodes;

a partition wall formed on the dielectric layer of the first substrate along the second direction, disposed between the first and the second substrate to define a plurality of discharge cells;

a groove formed on the partition wall, extended along the second direction and separated in respect to the plurality of discharge cells;

a reflection preventive layer formed on the groove; and at least a portion of the reflection preventive layer filling an inside of the groove.

16. The PDP of claim 15, wherein the reflection preventive layer fills an inside of the groove and covers a top portion of the partition wall.

17. The PDP of claim 15, wherein a gas exhaust path is formed between a gap provided by the groove and the second substrate.

18. The PDP of claim 15, wherein a width of the groove is narrower than a width of the partition wall.

19. The PDP of claim 15, wherein a depth of the groove is greater than 0 μm and less than a height of the partition wall.

20. The PDP of claim 15, wherein the reflection preventive layer comprises $CaMgSi_2O_8:Eu^{2+}$.

21. The PDP of claim 15, wherein the reflection preventive layer comprises a mixture of $CaMgSi_2O_8:Eu^{2+}$ and $BaMgAl_{10}O_{17}:Eu^{2+}$.

22. A Plasma Display Panel (PDP), comprising:

a first substrate;

a second substrate arranged parallel to the first substrate;

a plurality of address electrodes formed on the first substrate along a first direction;

a plurality of common and scan electrodes formed on the second substrate along a second direction perpendicular to the first direction;

a dielectric layer formed on both the first and the second substrate and covering the address, the common and the scan electrodes;

a partition wall formed on the dielectric layer of the first substrate along the second direction, disposed between the first and the second substrate to define a plurality of discharge cells;

a groove formed on the partition wall, extended along the second direction and separated in respect to the plurality of discharge cells;

a reflection preventive layer formed on the groove wherein the reflection preventive layer is made of CMS fluorescent material; and at least a portion of the reflection preventive layer filling an inside of the groove.

23. The PDP of claim 22, wherein the reflection preventive layer fills an inside of the groove and covers a top portion of the partition wall.

24. The PDP of claim 22, wherein a gas exhaust path is formed between a gap provided by the groove and the second substrate.

25. The PDP of claim 22, wherein a width of the groove is narrower than a width of the partition wall.

26. The PDP of claim 22, wherein a depth of the groove is greater than 0 μm and less than a height of the partition wall.

27. The PDP of claim 22, wherein the CMS fluorescent material comprises $CaMgSi_2O_8:Eu^{2+}$.

28. The PDP of claim 22, wherein the CMS fluorescent material comprises a mixture of $CaMgSi_2O_8:Eu^{2+}$ and $BaMgAl_{10}O_{17}:Eu^{2+}$.

* * * * *